US007937036B2

(12) United States Patent
Tanaka et al.

(10) Patent No.: US 7,937,036 B2
(45) Date of Patent: May 3, 2011

(54) COLLECTED DEVELOPER CONVEYING DEVICE AND IMAGE FORMING APPARATUS WHICH VENTS A DEVELOPING CONTAINER

(75) Inventors: Shigeru Tanaka, Kanagawa (JP); Tomokazu Kurita, Kanagawa (JP); Satoshi Honobe, Kanagawa (JP); Yukihiro Ichiki, Kanagawa (JP); Taro Mitsui, Kanagawa (JP); Yasutaka Matsumoto, Kanagawa (JP); Toshiyuki Matsui, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 394 days.

(21) Appl. No.: 12/142,635

(22) Filed: Jun. 19, 2008

(65) Prior Publication Data

US 2009/0154972 A1 Jun. 18, 2009

(30) Foreign Application Priority Data

Dec. 13, 2007 (JP) ..... P2007-322586

(51) Int. Cl.
*G03G 21/00* (2006.01)

(52) U.S. Cl. ..... 399/358

(58) Field of Classification Search ..... 399/358, 399/359

See application file for complete search history.

(56) References Cited

U.S. PATENT DOCUMENTS 5,250,997 A * 10/1993 Kaneko et al. ..... 399/99
2009/0080947 A1* 3/2009 Suzuki et al. ..... 399/302
2009/0087223 A1* 4/2009 Yabuki ..... 399/258

FOREIGN PATENT DOCUMENTS

JP 2006-235433 A 9/2006
JP 2007-102065 A 4/2007

OTHER PUBLICATIONS

Japanese Patent Office Action issued in application No. 2007-322586 dated Jan. 12, 2010.

* cited by examiner

*Primary Examiner* — Quana M Grainger
(74) *Attorney, Agent, or Firm* — Sughrue Mion, PLLC

(57) ABSTRACT

A collected developer conveying device includes: a conveying passage through which collected developer is conveyed; a conveying member that is disposed in the conveying passage, and conveys the developer in the conveying passage by rotation thereof; a developer carrying body that holds developer on a surface thereof, and that is relatable; and a ventilation passage through which air passes from a developing container including the developer carrying body, wherein the conveying passage includes an air flow region formed in a part thereof upper than a rotational center of the conveying member in a gravitational direction, in a side of the conveying passage in which the conveying member rotates from an upper part of the conveying passage to a lower part thereof in the gravitational direction.

16 Claims, 11 Drawing Sheets

COLLECTED DEVELOPER CONVEYING DEVICE AND IMAGE FORMING APPARATUS WHICH VENTS A DEVELOPING CONTAINER

CROSS-REFERENCE TO RELATED APPLICATIONS

This application is based on and claims priority under 35 U.S.C. 119 from Japanese Patent Application No. 2007-322586 filed Dec. 13, 2007.

BACKGROUND

Technical Field

The present invention relates to a collected developer conveying device and an image forming apparatus.

SUMMARY

According to an aspect of the present invention, a collected developer conveying device includes: a conveying passage through which collected developer is conveyed; a conveying member that is disposed in the conveying passage, and conveys the developer in the conveying passage by rotation thereof; a developer carrying body that holds developer on a surface thereof, and that is relatable; and a ventilation passage through which air passes from a developing container including the developer carrying body, wherein the conveying passage includes an air flow region formed in a part thereof upper than a rotational center of the conveying member in a gravitational direction, in a side of the conveying passage in which the conveying member rotates from an upper part of the conveying passage to a lower part thereof in the gravitational direction.

BRIEF DESCRIPTION OF THE DRAWINGS

Exemplary embodiment of the present invention will be described in detail based on the following figures, wherein:

FIG. 3A is a sectional perspective view illustrating a principal part thereof in a state where a developing container cover is removed, FIG. 3B is an explanatory view illustrating a feeding auger, and FIG. 3C is an explanatory view illustrating a stirring auger;

FIG. 7A is a explanatory view illustrating the whole passage, FIG. 7B is a view taken along the line VIIB-VIIB as viewed in the direction of an arrow shown in FIG. 7A, and FIG. 7C is a view taken along the line VIIC-VIIC as viewed in the direction of an arrow shown in FIG. 7B;

FIG. 8A is a sectional view taken along the line VIIIA-VIIIA shown in FIG. 7A, FIG. 8B is a sectional view taken along the line VIIIB-VIIIB shown in FIG. 7A, FIG. 8C is a sectional view taken along the line VIIIC-VIIIC shown in FIG. 7A, FIG. 8D is a sectional view taken along the line VIIID-VIIID shown in FIG. 7A, and FIG. 8E is a sectional view taken along the line VIIIE-VIIIE shown in FIG. 7A;

DETAILED DESCRIPTION

Figure 1:
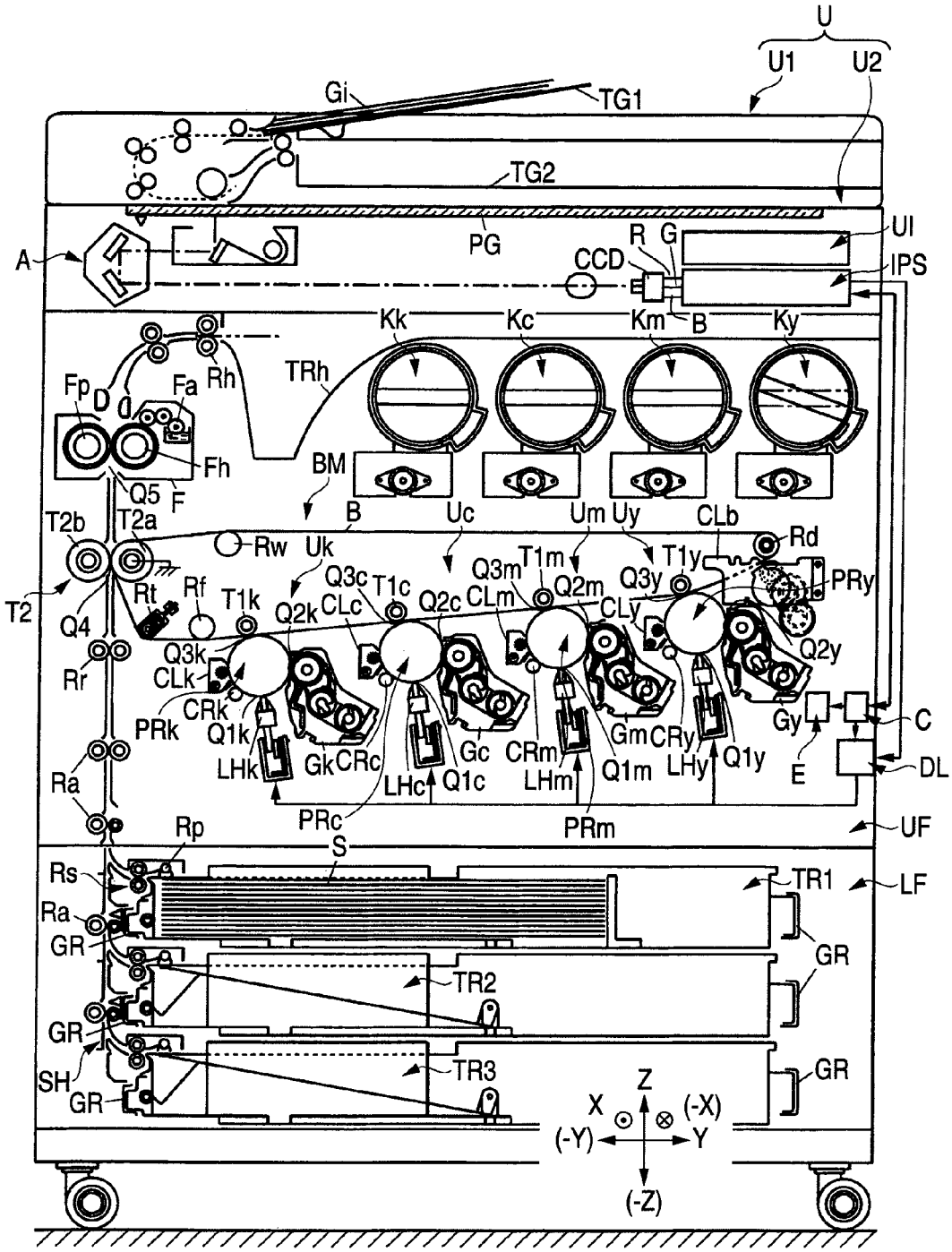
FIG. 1 is an explanatory view illustrating an entire configuration of an image forming apparatus according to Example 1 of the invention.

Hereinafter, specific examples according to an embodiment of the invention will be described with reference to the drawings. However, the invention is not limited to the following examples.

In order to make the understanding of the following description easier, in the drawings, the forward-and-backward direction is set as an X-axis direction, the right-and-left direction is set as a Y-axis direction, and the up-and-down direction is set as a Z-axis direction. The directions or sides indicated by arrows X, −X, Y, −Y, Z, −Z represent the forward direction, the backward direction, the right direction, the left direction, the upward direction and the downward direction, or the front side, the back side, the right side, the left side, the upper side and the lower side.

In addition, a reference sign represented by '•' included in '○' is defined as an arrow that represents a direction from the back side of paper toward the front side thereof, and a reference sign represented by 'x' included in '○' is defined as an arrow that represents a direction from the front side of paper toward the back side thereof.

In the description referring to the drawings, the members unnecessary for the description is appropriately omitted in the drawings in order to help to understand the description.

Example 1

FIG. 1 is an explanatory view illustrating the entire configuration of an image forming apparatus according to Example 1 of the invention.

In FIG. 1, an image forming apparatus U is equipped with an automatic document feeder U1 and image forming apparatus main body U2 supporting the conveyor and having a transparent image reading platen PG formed on the upper end thereof.

The automatic document feeder U1 has a sheet feeding section TG1 in which a plurality of sheets Gi to be copied are received so as to be overlapped, and a sheet discharging section TG2 in which the sheets Gi fed from the sheet feeder TG1 and conveyed through the sheet reading position on the image reading platen PG are discharged.

The image forming apparatus main body U2 includes a manipulation section UI in which a user inputs and manipulates the instruction signals for operating the image formation process, an exposure optical system A, and the like.

A solid state imaging device CCD converts a reflection light, which is reflected from the sheet manually placed on the image reading platen PG or the sheet Gi conveyed from the automatic document feeder U1 to the image reading platen PG, into electric signals, which is received from the CCD, of red R, green G, and blue B, via the exposure optical system A.

The image processing section IPS converts the electric signals of RGB into image data of yellow Y, magenta M, cyan C, and black K, temporally memorizes the image data, and outputs the image data to a driving circuit for latent image forming device DL as image data for forming a latent image at a predetermined timing.

In addition, when the sheet image is monochrome, image data of only black K is given as an input to the driving circuit for latent image forming device DL.

The driving circuit for latent image forming device DL has different driving circuits for the colors of Y, M, C, and K, and outputs a driving signal based on the inputted image data to latent image forming devices LHy, LHm, LHc, and LHk as an example of an electrostatic latent image forming device at a predetermined timing.

Figure 2:
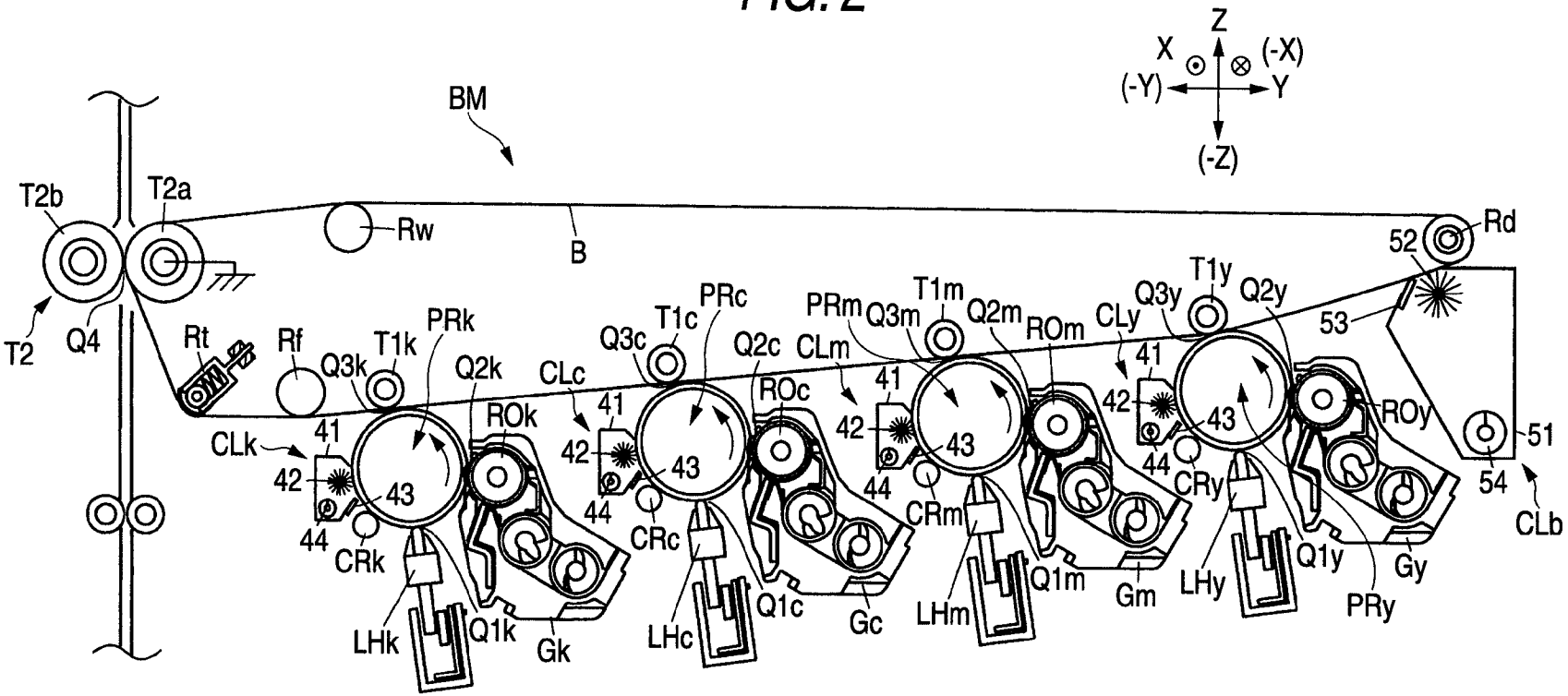
FIG. 2 is an explanatory enlarged view illustrating a principal part of the image forming apparatus according to Example 1.

FIG. 2 is an explanatory enlarged view illustrating the principal part of the image forming apparatus according to Example 1.

A visible image forming devices Uy, Um, Uc, and Uk, which are disposed on the center portion of the image forming apparatus U in the gravitational direction, form visible images corresponding to the respective colors of Y, M, C, and K.

Y, M, C, and K latent image writing beams Ly, Lm, Lc, and Lk emitted from the latent image writing beam source of the latent image forming devices LHy to LHk are incident into rotating image carrying bodies PRy, PRm, PRc, and PRk, respectively. In addition, in Example 1, the latent image forming devices LHy to LHk are formed by so called LED arrays.

The Y visible image forming device Uy has the rotating image carrying body PRy, the charger CRy, the latent image forming device LHy, the developing device Gy, the transfer unit T1*y*, and an image carrying body cleaner CLy. In addition, in Example 1, the image carrying body PRy, the charger CRy, and the image carrying body cleaner CLy are integrally formed as an image carrying body unit detachable with respect to the image forming apparatus main body U2.

All the visible image forming devices Um, Uc, and Uk are configured similarly to the Y visible image forming device Uy.

In FIGS. 1 and 2, the image carrying bodies PRy, PRm, PRc, and PRk are charged by the chargers CRy, CRm, CRc, and CRk respectively, and then the electrostatic latent image is formed on image writing positions Q1*y*, Q1*m*, Q1*c*, and Q1*k* of the surface thereof by the latent image writing beams Ly, Lm, Lc, and Lk. The electrostatic latent image formed on the surfaces of the image carrying bodies PRy, PRm, PRc, and PRk is developed into a toner image as an example of the visible image in developing regions Q2*y*, Q2*m*, Q2*c*, Q2*k* by the developer carried by developing rollers ROy, ROm, ROc, and ROk as an example of the developer carrying body of the developing devices Gy, Gm, Gc, and Gk.

The developed toner image is carried into primary transfer regions Q3*y*, Q3*m*, Q3*c*, and Q3*k* that come into contact with an intermediate transfer belt B as an example of the intermediate transfer body. Then, the primary transferring voltage, the polarity of which is opposite to the charged polarity of the toners, is applied to primary transfer units T1*y*, T1*m*, T1*c*, and T1*k*, which are arranged on the rear surface side of the intermediate transfer belt B in the primary transfer regions Q3*y*, Q3*m*, Q3*c*, and Q3*k*, at a predetermined timing from a power supply circuit E that is controlled by a control section C.

The toner image formed on the respective image carrying bodies PRy to PRk is primary-transferred onto the intermediate transfer belt B by the primary transfer units T1*y*, T1*m*, T1*c*, and T1*k*. Residual substances and attached substances on the surfaces of the image carrying bodies PRy, PRm, PRc, and PRk that are subjected to the primary transfer are cleaned by image carrying body cleaners CLy, CLm, CLc, and CLk. The cleaned surface of the image carrying bodies PRy, PRm, PRc, and PRk is recharged by the chargers CRy, CRm, CRc, and CRk.

A belt module BM as an example of the intermediate transfer device, which can be moved vertically and be pulled out forward, is arranged over the image carrying bodies PRy to PRk. The belt module BM includes: the intermediate transfer belt B; a belt driving roller Rd as an example of a driving member of the intermediate transfer body; a tension roller Rt as an example of a tension generating member of the intermediate transfer body; a walking roller Rw as an example of a meandering prevention member; an idler roller Rf as an example of a driven member; a back-up roller T2*a* as an example of a secondary transfer region member; and the primary transfer unit T1*y*, T1*m*, T1*c*, and T1*k*. Then, the intermediate transfer belt B is rotatably and movably supported by the belt supporting rollers Rd, Rt, Rw, Rf, and T2*a* as an example of a supporting member of the intermediate transfer body constituted of the respective rollers Rd, Rt, Rw, Rf, and T2*a*.

A secondary transfer roller T2*b* as an example of a secondary transfer member is arranged to be opposed to the surface of the intermediate transfer belt B that contacts to the backup roller T2*a*. A secondary transfer unit T2 is constituted of the above rollers T2*a* and T2*b*. Also, a secondary transfer region Q4 is formed in the region that is opposed to the secondary transfer roller T2*b* and the intermediate transfer belt B.

Color toner images that are transferred onto the intermediate transfer belt B sequentially in the primary transfer regions Q3*y*, Q3*m*, Q3*c*, and Q3*k* by the primary transfer units T1*y*, T1*m*, T1*c*, and T1*k* to be superposed are carried into the secondary transfer region Q4.

A transfer device T1+T2+B according to Example 1 is constituted of the primary transfer units T1*y* to T1*k*, intermediate transfer belt B, the secondary transfer unit T2, and the like. The transfer device transfers the toner image on the image carrying bodies PRy, PRm, PRc, and PRk into a medium.

A pair of three-stage guide rails GR as an example of a guide member is provided below the visible image forming device Uy to Uk. In the guide rails GR, the sheet feeding trays TR1 to TR3 are slidably supported in the frontward and backward direction. Recording sheets S as an example of a medium placed in the sheet feeding trays TR1 to TR3 are picked up by a pickup roller Rp as an example of an ejecting member, and then are separated by a separating roller Rs as an example of a medium separating member one by one. Then, the recording sheets S are conveyed along a sheet conveying path SH by a plurality of conveying rollers Ra as an example of a medium conveying member and are sent to a registration roller Rr as an example of a member for controlling a transfer position and a timing of conveyance. The registration roller Rr is disposed on an upstream side in the sheet conveying direction of the secondary transfer region Q4. A sheet conveying device SH+Ra+Rr is constituted of the sheet conveying path SH, the sheet conveying rollers Ra, the registration roller Rr, and the like.

The registration roller Rr conveys the recording sheet S into the secondary transfer region Q4 at the same timing at which the toner image formed on the intermediate transfer belt B is conveyed into the secondary transfer region Q4. When the recording sheet S is passed through the secondary transfer region Q4, the backup roller T2*a* is grounded and then the secondary transfer voltage that has the opposite polarity to the charged polarity of the toners is applied to the secondary transfer roller T2*b* from the power supply circuit E, which is controlled by the control section C, at the predetermined timings. At this time, the color toner image on the intermediate transfer belt B is transferred onto the recording sheet S by the secondary transfer unit T2.

After the secondary transfer, the intermediate transfer belt B is cleaned by the belt cleaner CLb as an example of an intermediate transfer body cleaner.

The recording sheet S on which the toner image is secondary-transferred are conveyed into a fixing region Q5 that is a pressure-contact region between a heating roller Fh as an example of a heat-fixing member and a pressing roller Fp as an example of a press-fixing member of a fixing device F, and then is heated and fixed when they are passed through the fixing region Q5. The heated/fixed recording sheet S is discharged from a discharging roller Rh as an example of a medium discharging member into a sheet discharging tray TRh as an example of a medium discharging section.

In this case, a release agent that improves the releasability of the recording sheet S from the heating roller is coated on a surface of the heating roller Fh by a release agent coating unit Fa.

Developer cartridges Ky, Km, Kc, and Kk as an example of a developer replenishing container in which yellow Y, magenta M, cyan C, and black K developers are contained respectively are arranged over the belt module BM. The developers contained in the developer cartridges Ky, Km, Kc, and Kk are supplied to the developing devices Gy, Gm, Gc, and Gk in response to the consumption of the developers in the developing devices Gy, Gm, Gc, and Gk. In Example 1, as the developer contained in the developing devices Gy to Gk, there is provided a two-component developer including magnetic carrier and toner in which an external additive is added. In addition, the developer cartridges Ky to Kk supply a so-called high density toner having a higher ratio of toner to carrier than the developer in the developing devices Gy to Gk.

In FIG. 1, the image forming apparatus U has an upper frame UF and a lower frame LF. The visible image forming devices Uy to Uk and the members arranged over the visible image forming devices Uy to Uk, that is, the belt module BM and the like are supported on the upper frame UF.

In addition, the guide rails GR that support the sheet feeding trays TR1 to TR3 and the sheet feeding members that feed the papers from the trays TR1 to TR3, that is, the pickup roller Rp, the separating roller Rs, and the sheet conveying roller Ra are supported onto the lower frame LF.

(Description of Developing Device)

Figure 3A:
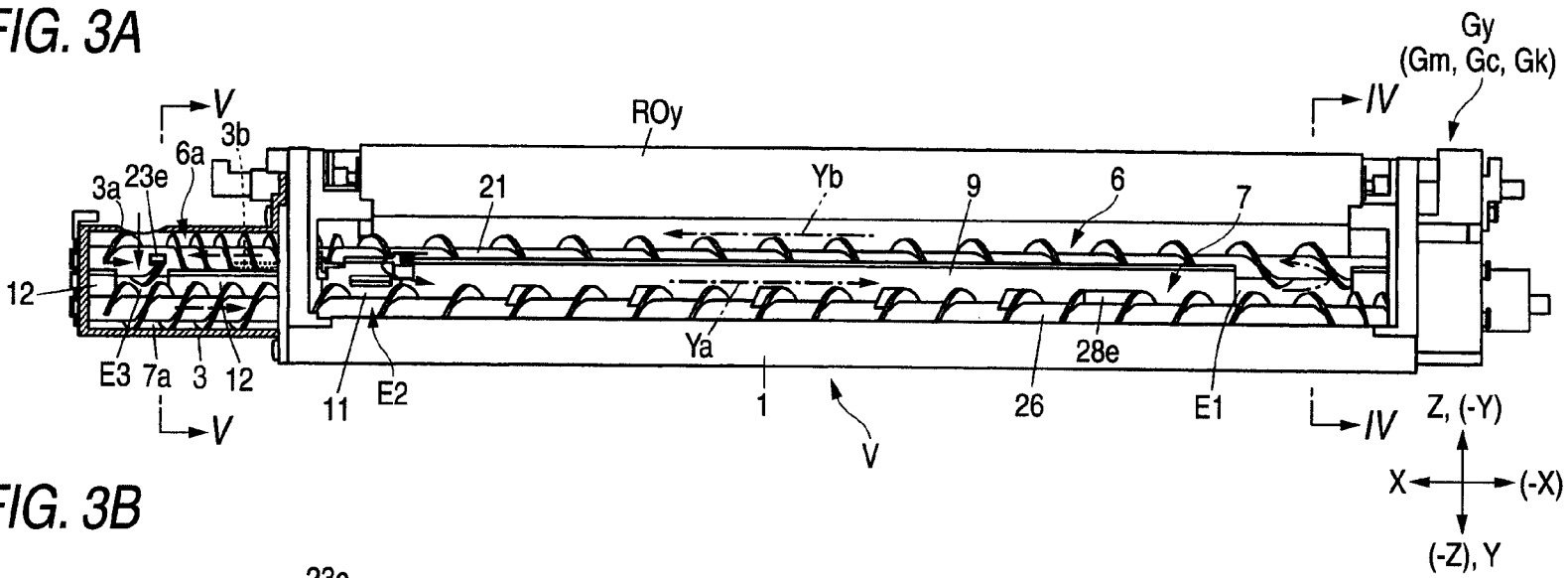
FIGS. 3A to 3C are explanatory views illustrating a developing device according to Example 1 of the invention, where
Figure 3B:
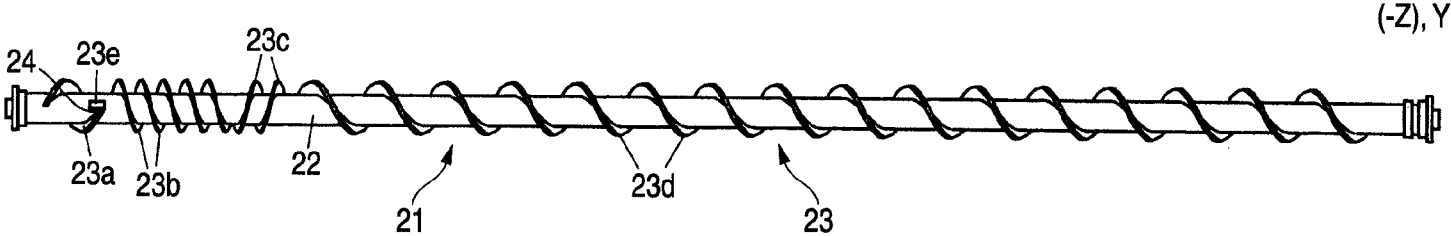
Figure 3C:
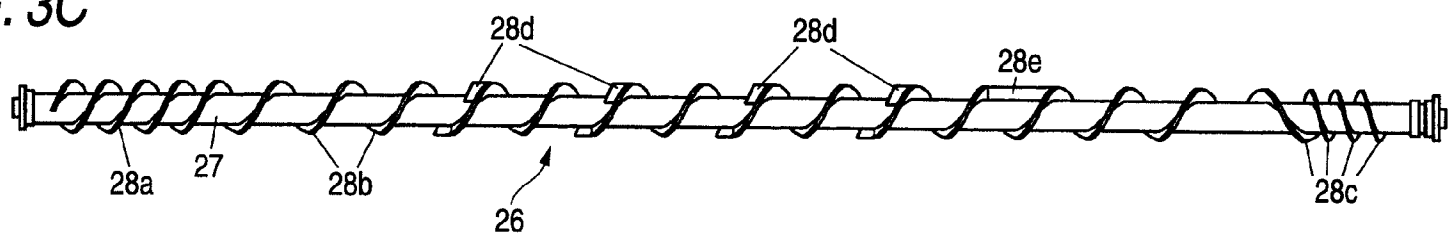

FIG. 3 is an explanatory view illustrating the developing device according to Example 1 of the invention, where FIG. 3A is a sectional perspective view illustrating the principal part thereof in a state where a developing container cover is removed, FIG. 3B is an explanatory view illustrating a feeding auger, and FIG. 3C is an explanatory view illustrating a stirring auger.

Figure 4:
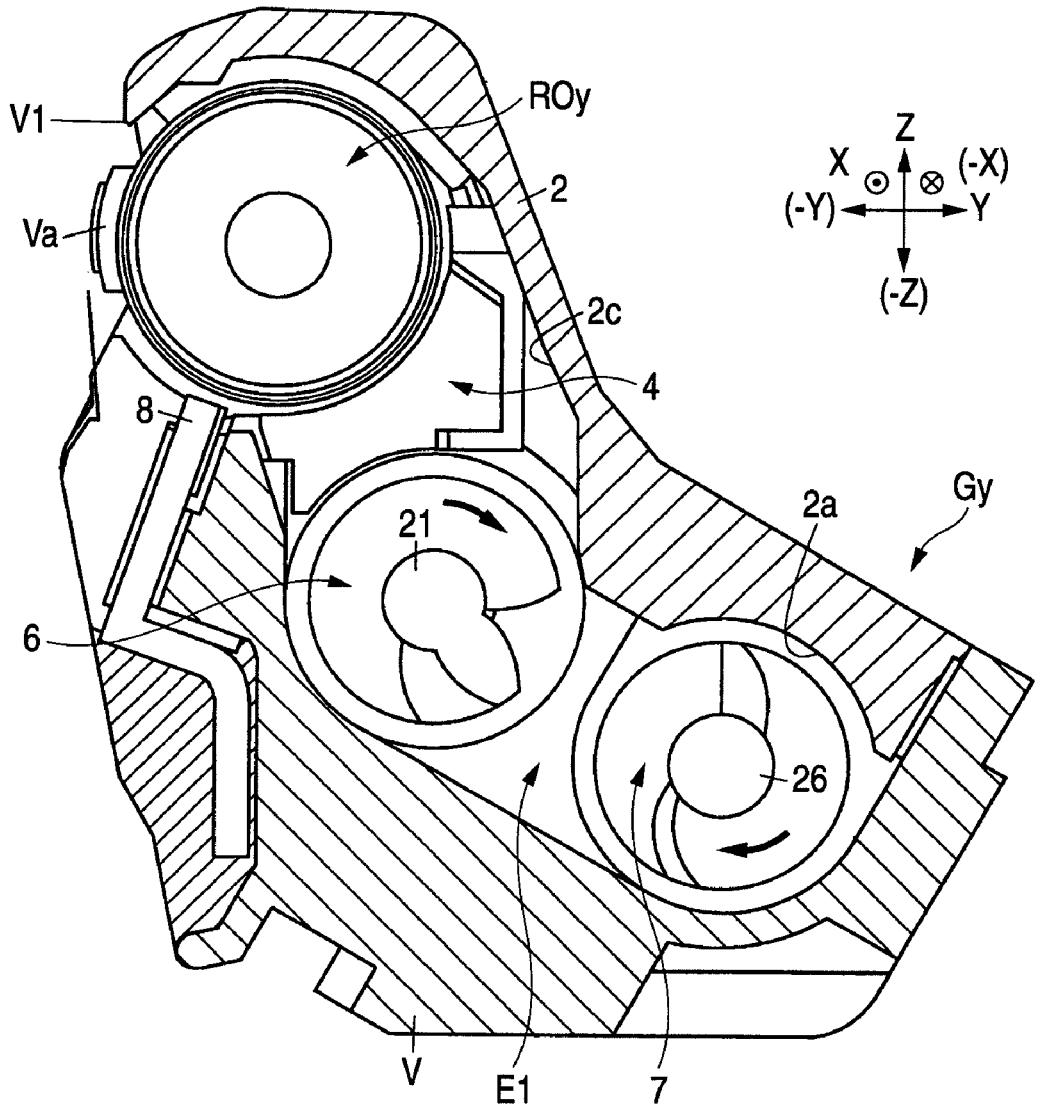
FIG. 4 is a sectional view taken along the line IV-IV shown in FIG. 3A.

FIG. 4 is a sectional view taken along the line IV-IV shown in FIG. 3A.

Figure 5:
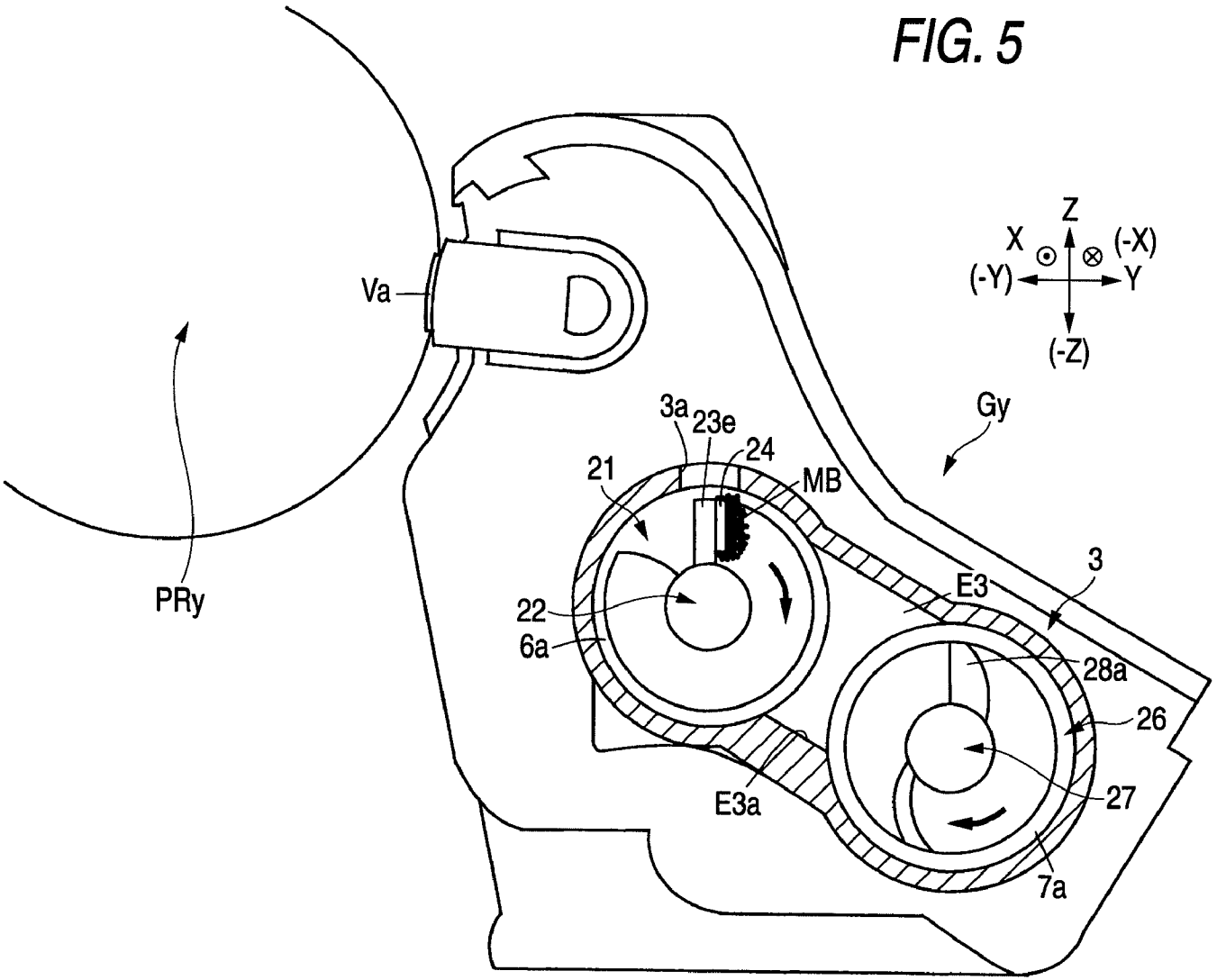
FIG. 5 is a sectional view taken along the line V-V shown in FIG. 3A.

FIG. 5 is a sectional view taken along the line V-V shown in FIG. 3A.

Next, the developing devices Gy, Gm, Gc, and Gk according to Example 1 of the invention will be described. However, since the developing devices Gy, Gm, Gc, and Gk of the colors have the same configuration, only the developing device Gy of Y color will be described in detail, but description of the developing devices Gm, Gc, and Gk of the other colors will be omitted.

In FIGS. 2 to 5, the developing device Gy that is disposed to be opposed to the image carrying body PRy has a developer container V containing two-component developer including toner and carrier. The developer container V has a developer container body 1, a developer container cover 2 as an example of a cover member for covering an upper end of the developer container body 1 as shown in FIG. 4, and a developer exhausting vessel 3 as an example of a developer exhausting member connected to a front end of the developer container body 1 as shown in FIG. 3. In FIG. 4, the developing container V of Example 1 has an aperture V1 formed thereof to correspond to the developing region Q2*y* opposed to the image carrying body PRy.

In FIGS. 2 to 4, the developer container body 1 has a developing roller space 4, a first stirring space 6 as an example of a first developer containing space adjacent to the developing roller space 4, and a second stirring space 7 as an example of a second developer containing space that is disposed diagonally adjacent to the right lower side of the first stirring space 6 in order to decrease a size of developer container V in a horizontal direction and a vertical direction, in an inner side of the developer container body 1. A developing roller ROy as an example of the developer carrying body is contained in the developing roller space 4. In addition, a part of an outer surface of the developing roller ROy is exposed by an aperture V1 toward the image carrying body PRy, and is disposed to be opposed to the image carrying body PRy. A thickness regulating member 8 for regulating a layer thickness of developer on a surface of the developing roller ROy is disposed on an upstream side in a rotation direction of the developing roller ROy.

In FIG. 4, a direct contacting member Va, that is, a so-called tracking member for maintaining a distance between the developing roller ROy and the image carrying body PRy at a predetermined distance is supported on both of the front and rear ends of the developing container V, on a side opposed to the image carrying body PRy.

In FIG. 3, the exhausting space 6*a* inside the developer exhausting vessel 3 is connected to a front side of the first stirring space 6, and a replenishing space 7*a* inside the developer exhausting vessel 3 is connected to a front side of the second stirring space 7. In FIG. 3, the developer replenishing port 3*a* as an example of a new developer inflow section that replenishes developer from the developer cassettes Ky, Km, Kc, and Kk is formed on an upper surface of the front end portion of the exhausting space 6*a*. In addition, a developer outlet 3*b* as an example of a developer discharging section is formed on a lower surface of a rear portion of the exhausting space 6*a*, and the developer deteriorated in an inside thereof is discharged from the developer outlet 3*b*. Thus, the carrier of the inside is gradually exchanged.

In the developer container body 1 as shown in FIG. 3, a division wall 9 is formed on a portion between the first stirring space 6 and the second stirring space 7 other than both end portions. In FIGS. 3 and 4, the first stirring space 6 and the second stirring space 7 communicates with each other in an upflow section E1 as an example of the first inflow section disposed on the rear end portion thereof and in a downflow section E2 as an example of the second inflow section disposed on a front side thereof. Therefore, the developer container body 1 is configured to be able to circulate developer. An opening forming member 11 in which an aperture for adjusting inflow amount of developer is formed is mounted on the downflow section E2.

In the developer exhausting vessel 3, a division wall 12 is formed between the exhausting space 6*a* and the replenishing space 7*a*. Accordingly, as shown in FIG. 3, the exhausting space 6*a* and the replenishing space 7*a* are connected to each other through a replenishing inflow section E3 as an example of the third inflow section. Therefore, developer can flow from the exhausting space 6*a* into the replenishing space 7*a*.

A circulation stirring space 6+7 includes the first stirring space 6 and the second stirring space 7.

In FIGS. 3 to 4, in the first stirring space 6, a feeding auger 21 as an example of a first conveying member for conveying developer while stirring the developer and as an example of a supplying member for supplying developer to the developing roller ROy.

In FIGS. 3A to 3B, the feeding auger 21 has a first rotation shaft 22 extended along the axial direction of the developing roller ROy and a helical first conveyor blade 23 supported by the outer circumference of the first rotation shaft 22. In addition, the first conveyor blade 23 includes: a replenishing backward-direction conveyor blade 23*a* disposed corresponding to the front end portion of the exhausting space 6*a*; an exhausting conveyor blade 23*b* as an example of a fourth conveying member disposed corresponding to the range from the center portion of the exhausting space 6*a* to the rear portion; a circulating backward-direction conveyor blade 23*c* as an example of a third conveying member and a backward-direction conveying portion disposed corresponding to the range from the rear end portion of the exhausting space 3*a* to the front side of the downflow section E2; and a first main stirring conveyor blade 23*d* disposed corresponding to the range from the downflow section E2 to the rear end of the first stirring space 6.

In Example 1, the blades 23*a* to 23*d* are formed in a helical shape. In this case, when a pitch is defined as a distance that developer moves during one rotation of the first main stirring conveyor blade 23*d*, that is, a distance between blades adjacent to each other in the axial direction, a pitch of the conveyor blade 23*d* is set larger than a pitch of the conveyor blades 23*a* to 23*c*. In the upflow section E1 as shown in FIG. 4, the feeding auger 21 of Example 1 rotates in order of an upper part thereof in the gravitational direction, the second developer containing space side, and a lower part thereof in the gravitational direction, and, also in the replenishing inflow section E3 as shown in FIG. 5 to be described later, rotates in the same manner as just mentioned above. In Example 1, the feeding auger 21 is configured so that the first rotation shaft 22 and the first conveyor blade 23 are integrally formed of resin. However, it is possible to separately form the shaft and the conveyor blade and assemble them. In Example 1, the blades 23*a* to 23*d* is disposed on the one first rotation shaft 22, but not limited to this configuration. For example, it is possible to separately form the blades and shafts like the replenishing backward-direction conveyor blade 23*a* and the rotation shaft thereof, the exhausting conveyor blade 23*b* and the rotation shaft thereof, the circulating backward-direction conveyor blade 23*c* and the rotation shaft thereof, and the first main stirring conveyor blade 23*d* and the rotation shaft thereof.

In FIGS. 3A to 3C, in the second stirring space 7, a stirring auger 26 as an example of a second conveying member that conveys developer while stirring the developer and as an example of a stirring member that stirs the developer. The stirring auger 26 has a second rotation shaft 27 extended along an axial direction of the developing roller ROy and a helical second conveyor blade 28 supported by the outer circumference of the second rotation shaft 27. The second conveyor blade 28 includes: a replenishing conveyor blade 28*a* disposed corresponding to the replenishing space 7*a*; a second main stirring conveyor blade 28*b* disposed corresponding to the range from the downflow section E2 to the front side of the upflow section E1; and a backward-direction conveyor blade 28*c* disposed on the rear end portion of the second main stirring space 7.

In Example 1, the blades 28*a* to 28*c* are formed in a helical shape. In addition, a pitch of the second main stirring conveyor blade 28*b* is set larger than each of pitches of the conveyor blades 23*a* to 23*c*. As shown in FIG. 3, a plurality of stirring members 28*d* having a planar shape are disposed at predetermined distances and are supported by a second rotation shaft 28, in a region where a second main conveyor blade 28*b* is disposed. In FIG. 3C, a stirring paddle 28*e* as a stirring section is supported by the second rotation shaft 28, on the left side of the backward-direction conveyor blade 28*c*. In the stirring member 28*d* and stirring paddle 28*e*, a conveying force in a main direction becomes larger than a conveying force in an axial direction of the second rotation shaft 28. Particularly, in Example 1, the stirring member 28*d* and stirring paddle 28*e* is formed of a member having a plate shape along the second rotation shaft 28, in which the conveying force in the axial direction thereof is scarcely generated by the stirring member 28*d* and stirring paddle 28*e*.

In addition, the stirring auger 26 of Example 1 is integrally formed in the same manner as the feeding auger 21. In Example 1, the blades 28*a* to 28*c* are disposed on the one second rotation shaft 27, but not limited to this. For example, it is possible to separately form the blades and shafts like the replenishing conveyor blade 28*a* and the rotation shaft thereof, second main stirring conveyor blade 28*b* and the rotation shaft thereof, and backward-direction conveyor blade 28*c* and the rotation shaft thereof.

When the conveying members 21 and 26 rotates, the replenishing backward-direction conveyor blade 23*a* and the ventilating conveyor blade 23*b* flows the developer replenished from the developer replenishing port 3*a* into the replenishing inflow section E3 and conveys the developer to the replenishing space 7*a*. The developer conveyed to the replenishing space 7*a* is conveyed to the second stirring space 7 in the developer container body 1 by the replenishing conveyor blade 28*a*. Then, the developer is conveyed to the second developer conveying direction Ya by the second main conveyor blade 28*b*. The developer conveyed to the upflow section E1 is stayed by the second main conveyor blade 28*b* and the backward-direction conveyor blade 28*c* that conveys the developer in a direction opposite to the second developer conveying direction. Therefore, the developer amount increases, and the developer flows in the first stirring space 6 in a diagonally upward direction. In this case, in Example 1, the second stirring space 7 is disposed diagonally adjacent to the right lower side of the first stirring space 6. Therefore, a rotation direction of the stirring auger 26 disposed on the second stirring space 7 is set as a clockwise direction in FIG. 4, that is, a direction of rotating in order of a lower part thereof in the gravitational direction, a side opposed to the first stirring space 6, and an upper part thereof in the gravitational direction. In addition, developer is conveyed to be pumped up to the left upper side, that is, the first stirring space 6 side by the second main conveyor blade 28*b* and the backward-direction conveyor blade 28*c* at the time of rotation thereof, whereby the inflow toward the first stirring space 6 is supplemented.

The developer flowing in the first stirring space 6 is conveyed by the first main conveyor blade 23*d* in a first developer conveying direction Yb opposite to the second developer conveying direction Ya. The developer conveyed to the first stirring space 6 is adhered to the surface of the developing roller ROy by magnetic force in the course of the conveying process, and is used in the developing process. The developer conveyed to the downflow section E2 is stayed in the downflow section E2 by the circulating backward-direction conveyor blade 23*c* for conveying the developer in a direction opposite to the first developer conveying direction Yb. Then, the developer flows in the second stirring space 7 through the downflow section E2 due to gravity. As a result, developer is circulated and conveyed while the developer in the stirring spaces 6 and 7 is stirred by the stirring members 21 and 26.

In addition, when the developer amount in the downflow section E2 increases, a part thereof can not be conveyed by the circulating backward-direction conveyor blade 23*c* in the backward direction. Thus, the residual developer flows even in the exhausting conveyor blade 23*b* of the exhausting space 7*a* side. In this case, the developer flowing over the circulating backward-direction conveyor blade 23*c* into the exhausting conveyor blade 23*b* side is conveyed to the developer outlet 3*b* and is exhausted therethrough, by the exhausting conveyor blade 23*b*.

(Description of Magnetic Member)

In FIGS. 3B and 5, a paddle 23*e* as an example of a stirring blade extended along the axial direction of the first rotation shaft 22 is disposed on the rear end of the helix of the replenishing backward-direction conveyor blade 23*a* in the axial direction thereof, that is, the end portion thereof on the upstream side in the first developer conveying direction Yb. In Example 1, the paddle 23*e* is integrally formed on the rotation shaft 23*e*, is continuously formed on the rear end of the helix of the replenishing backward-direction conveyor blade 23*a* in the axial direction, and is extended toward the frontside in the axial direction. In Example 1, as shown in FIG. 3A, the length of the paddle 23*e* in the axial direction is smaller than a length of the developer replenishing port 3*a* in the axial direction. In addition, the paddle 23*e* is disposed to be overlapped with a part of the developer replenishing port 3*a*, and is disposed not to block a part of the remainder thereof as viewed from the top of the developer replenishing port 3*a*. In addition, in Example 1, the length of the paddle 23*e* in the axial direction is set as a length not more than a half of one pitch, that is, a half pitch. In this case, the pitch is defined as a distance in the axial direction between a position on the helix of the replenishing backward-direction conveyor blade 23*a* and a position thereon that is shifted when one rotation is made along the helix.

In FIG. 5, as an example of a magnetic member generating magnetic force, a magnetic rubber 24 having elasticity and made of resin is supported on the paddle 23*e*. The magnetic rubber 24 is attached to a downstream side surface of the paddle 23*e* in a rotation direction of the feeding auger 21, by a double coated tape as an example of adhesive means.

In addition, in Example 1, lengths of the paddle 23*e* and the magnetic rubber 24 are set so that an outer end in a diameter direction does not come in contact with the wall surface of the exhausting space 6*a*.

Accordingly, developer is adhered by magnetic force of the magnetic rubber 24, the developer adhered by the rotation of the feeding auger 21 brings peripheral developer into the replenishing space 7*a*, and thus conveying force is applied to the developer. As a result, in the replenishing inflow section E3, staying and blocking of developer is reduced.

(Description Of Developer Replenishing Device)

Figure 6:
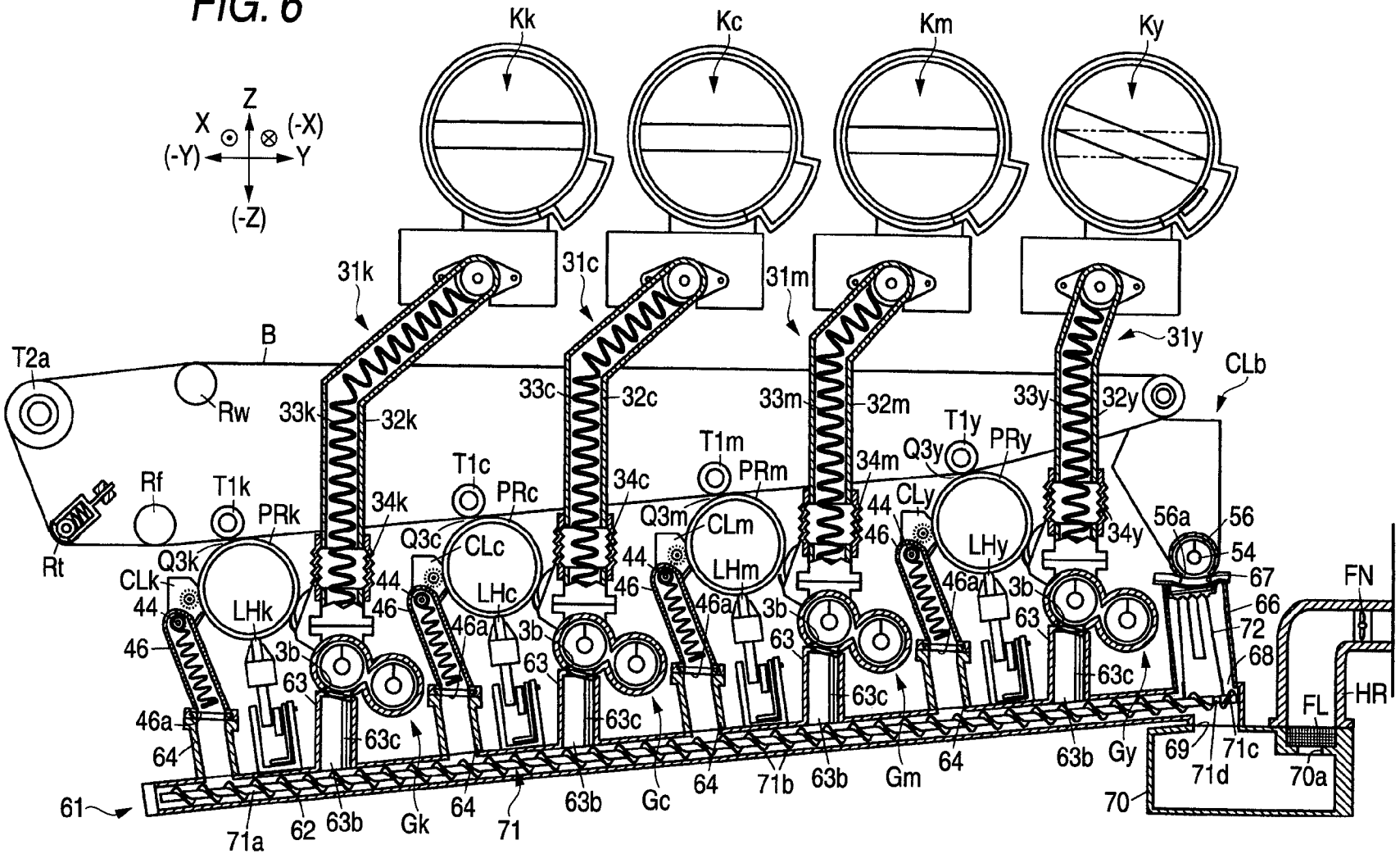
FIG. 6 is an explanatory view illustrating a developer replenishing device and the collected developer conveying device according to Example 1.

FIG. 6 is an explanatory view illustrating a developer replenishing device and the collected developer conveying device according to Example 1.

In addition, in FIG. 6, in order make the understanding easier, members such as the chargers CRy to CRk, and the magenta is properly omitted in the drawing.

In FIG. 6, the developer cartridges Ky, Km, Kc, and Kk containing the replenishing developer are detachably and exchangeably supported on the developer replenishing devices 31*y*, 31*m*, 31*c*, and 31*k*. The developer replenishing devices 31*y* to 31*k* have developer replenishing passages 32*y* to 32*k* which is extended from the developer cartridges Ky to Kk to the developing devices Gy to Gk and through which developer is conveyed. The developer replenishing passages 32*y* to 32*k* is set so as to replenish the developing devices Gy to Gk with developer in the front side of the image forming apparatus U. In the developer replenishing passages 32*y* to 32*k*, developer replenishing members 33*y* to 33*k* that rotates to convey the developer in the developer replenishing passages 32*y* to 32*k* are arranged. At the end portion of the developer replenishing passages 32*y* to 32*k* on the developing devices Gy to Gk side, the connection members 34*y* to 34*k* having a bellows shape for keeping connection state of the developer replenishing passages 32*y* to 32*k* at the time when the developing devices Gy to Gk are shifted by maintenance, inspection, exchange, and the like.

(Description of Image Carrying Body Cleaner and Intermediate Transfer Body Cleaner)

In FIG. 2, each of the image carrying body cleaners CLy to CLk has a cleaning vessel 41. In the cleaning vessel 41, removal members 42 and 43 for removing residues such as residual developer or paper powder attached to the surfaces of the image carrying bodies PRy to PRk are disposed while contacting the surface thereof. In Example 1, as an example of the residue removal members 42 and 43, there are provided a cleaning brush 42 formed in a cylindrical brush shape capable of contacting while rotating and a cleaning blade 43 formed in a plate shape capable of scrapping off the residues while contacting the image carrying bodies PRy to PRk. In addition, in Example 1, both of the cleaning brush 42 and the cleaning blade 43 are provided, but only one of them may be employed, and a known optional residue removal member such as a residue removal member made of fabric may be employed.

In FIG. 6, in the front end portion of the cleaning vessel 41, there is provided a residue discharge passage 46 extended downward and discharging the residues, which is conveyed by the residue conveying member 44, to the outside of the developer containing space by being connected to the inside of the cleaning vessel 41. In the lower end portion of the residue discharge passage 46, there is provided a residue outlet 46*a* through which residues conveyed by the residue conveying member 44 is discharged.

In FIGS. 2 and 6, similarly to the image carrying body cleaners CLy to CLk, the belt cleaner CLb includes a cleaning vessel 51, a removal member 52, 53, a residue conveying member 54, a residue discharge passage 56, and a residue outlet 56*a*.

(Description of Collected Developer Conveying Device)

Figure 7B:
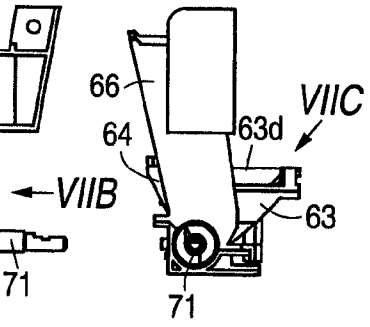
FIGS. 7A to 7C are explanatory views illustrating a collected developer conveying passage of the collected developer conveying device according to Example 1, where
Figure 7A:
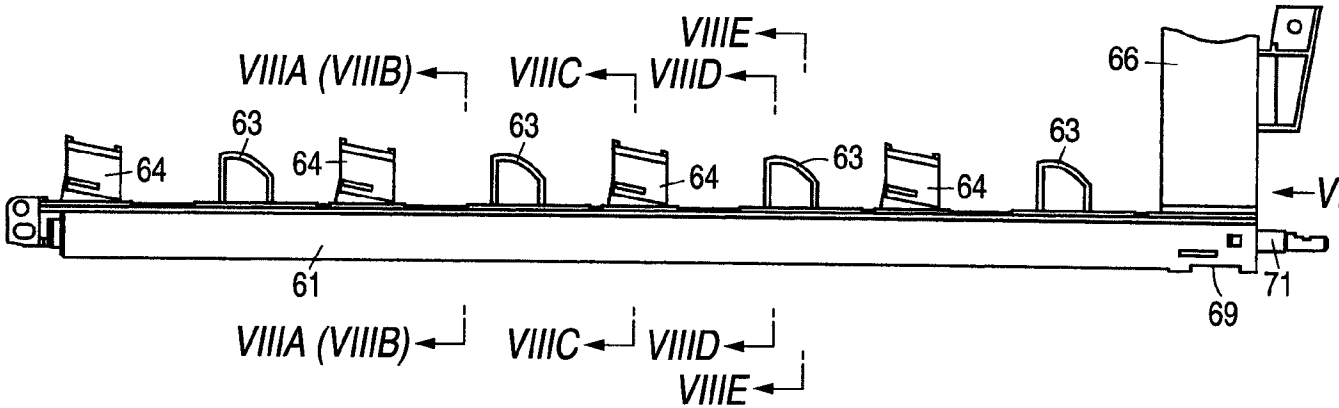
Figure 7C:
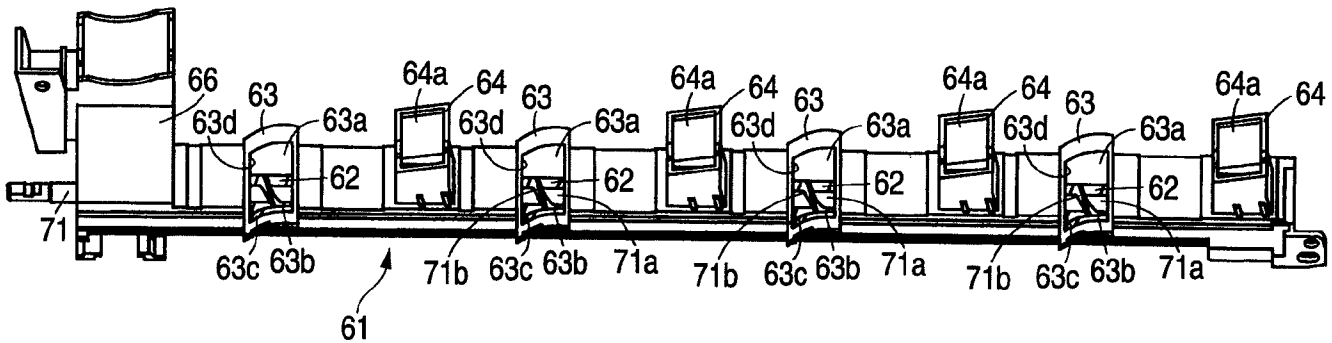

FIG. 7 is an explanatory view illustrating the collected developer conveying passage of the collected developer conveying device according to Example 1, where FIG. 7A is a explanatory view illustrating the whole passage, FIG. 7B is a view taken along the line VIIB-VIIB as viewed in the direction of an arrow shown in FIG. 7A, and FIG. 7C is a view taken along the line VIIC-VIIC as viewed in the direction of an arrow shown in FIG. 7B.

In FIG. 6, in the lower part of the visible image forming devices UY to UK on the front side of the image forming apparatus, a developer collecting device 61 as an example of the collected developer conveying device is disposed. The developer collecting device 61 has a collecting passage 62 as an example of the collected developer conveying passage diagonally extended from the left lower side toward the right upper side. In FIGS. 6 and 7, in the collecting passage 62, discharge connection passages 63 of the developing devices are formed to be diagonally extended upward as an example of the developer discharge passages and as an example of the ventilation passages that are connected to developer outlets 3*b* of the developing devices Gy to Gk, respectively. Likewise, in the collecting passage 62, discharge connection passages 64 of the image carrying body cleaners are formed to be diagonally extended upward as an example of inflow passages that are connected to the residue outlets 46*a* of the image carrying body cleaners CLy to CLk, respectively. In the right upper end portion of the collecting passage 62, a collected developer dropping passage 66 is formed to be extended upward as an example of a dropping passage.

In FIG. 6, in the upper end of the collected developer dropping passage 66, a collected developer inlet 67 is formed as an inlet which is connected to the residue outlet 56*a* of the belt cleaner CLb and through which developer flows. In addition, the lower end of the collected developer dropping passage 66 is connected to the right upper end portion of the collecting passage 62 through a connection section 68. Accordingly, in the collected developer dropping passage 66, the developer discharged from the residue outlet 56*a* is conveyed by dropping therethrough.

In FIG. 6, in the lower part of the collected developer dropping passage 66, a collected developer outlet 69 is formed as an example of an outlet so as to discharge developer conveyed through the collecting passage 62 and the collected developer dropping passage 66. In FIG. 3, the collected developer outlet 69 is connected to a developer receiving container 70 that receives the collected developer. In the developer receiving container 70, an air inlet 70*a* is formed at a position deviated from the developer outlet 69. A ventilating passage HR supported on the image forming apparatus main body U2 is connected to the air inlet 70*a*, and an air intake fan FN is disposed at an outer end of the ventilating passage HR as an example of an intake member for drawing air in the developer receiving container 70 and exhausting the air outside the image forming apparatus. In addition, in the air inlet 70*a*, a filter FL for removing developer included in air is disposed as an example of an air cleaner. The ventilating passage HR, the air intake fan FN, and the filter FL constitute an air intake unit HR+FN+FL according to Example 1.

In addition, in Example 1, each of the developing device discharge connection passages 63 and the image carrying body cleaner discharging connection passages 64 is formed as a dropping passage through which developer is conveyed by dropping.

In FIG. 6, in the collecting passage 62, a collecting auger 71 for conveying developer in the collecting passage 62 from the left lower side toward the right upper side is disposed as an example of a collected developer conveying member. In FIGS. 3 to 7, the collecting auger 71 includes a rotation shaft 71*a*, a first helical blade 71*b* as an example of a first helical portion that is formed in a helical shape in a predetermined direction and is formed in the range from a left lower end of the rotation shaft 71*a* to the right upper portion thereof, and a second helical blade 71*c* as an example of a second helical portion that is formed in a helical shape in a direction opposite to that of the first helical blade 71*b* and is formed at a right upper end portion of the rotation shaft 71*a*. In the collecting auger 71 of Example 1, a non-helical portion 71*d* that is constituted of only the rotation shaft 71*a* and has no helical blade formed thereon is formed between the first helical blade 71*b* and the second helical blade 71*c*. In FIG. 6, the non-helical portion 71*d* is set at a position corresponding to the inside of the collected developer outlet 69. Accordingly, as shown in FIG. 7, the first helical blade 71*b* and the second helical blade 71*c* is formed to be projected up to the position corresponding to the upper part of the collected developer outlet 69 in gravitational direction and the inside of the collected developer outlet 69. In addition, in Example 1, when the shift distance in the axial direction by amount of one rotation made along the helix of the first helical blade 71*b* is defined as a so-called pitch, a pitch of the first helical blade 71*b* is set larger than a pitch of the second helical blade 71*c*.

In FIG. 6, in the collected developer dropping passage 66, a developer loosening member 72 as an example of a loosening member is disposed. The developer loosening member 72 of Example 1 has a pair of left and right loosening portions each of which has one wire shaped member formed to be bent, and loosens developer by reciprocating in the axial direction as accompanied with rotation of the collecting auger 71 in contact with the helical blades 71*b* and 71*c* of the collecting auger 71.

(Description of Configurations of Collected Developer Conveying Passage, Collected Developer Conveying Member, Developer Discharge Passage, and Inflow Passage)

Figure 8C:
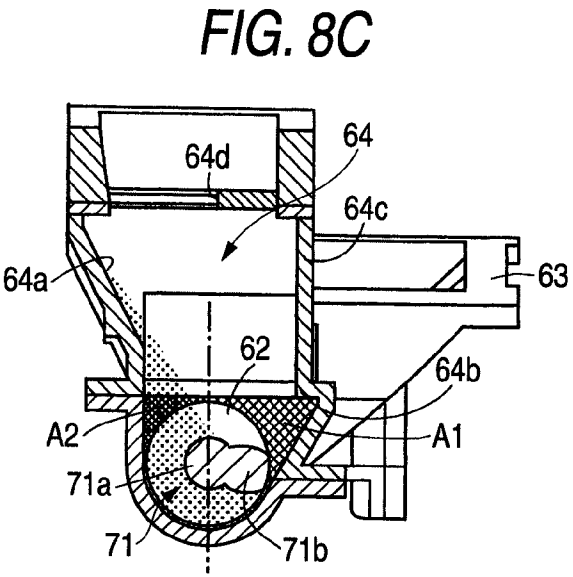
FIGS. 8A to 8E are sectional views illustrating the collected developer conveying passage, where
Figure 8B:
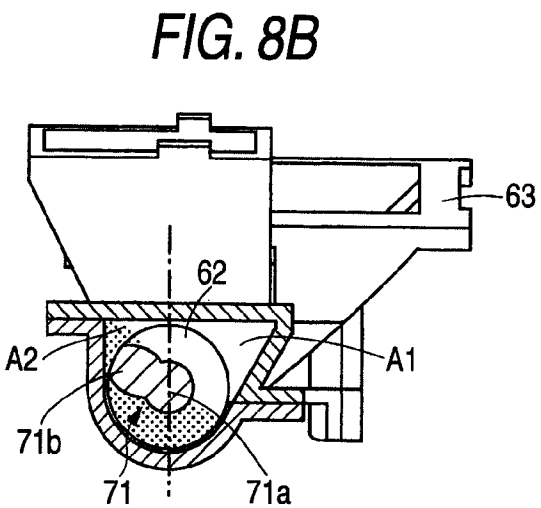
Figure 8A:
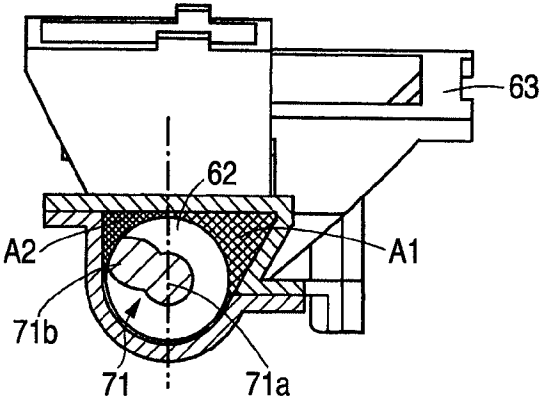
Figure 8E:
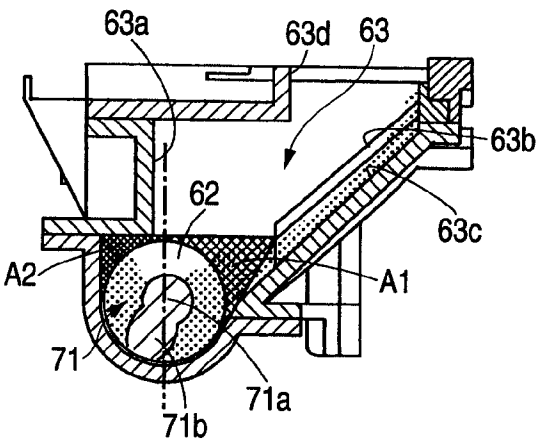
Figure 8D:
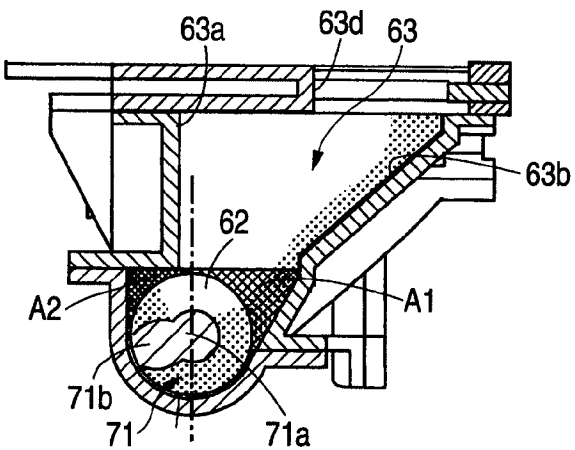

FIG. 8 is a sectional view illustrating the collected developer conveying passage, where FIG. 8A is a sectional view taken along the line VIIIA-VIIIA shown in FIG. 7A, FIG. 8B is a sectional view taken along the line VIIIB-VIIIB shown in FIG. 7A, FIG. 8C is a sectional view taken along the line VIIIC-VIIIC shown in FIG. 7A, FIG. 8D is a sectional view taken along the line VIIID-VIIID shown in FIG. 7A, and FIG. 8E is a sectional view taken along the line VIIIE-VIIIE shown in FIG. 7A.

In FIG. 8, a rotation direction of the collecting auger 71 is set as a clockwise direction in FIG. 8, that is, a direction of rotating in order of an upper part thereof in the gravitational direction, a right part thereof, a lower part thereof in the gravitational direction, and a left part thereof, as viewed from the front side in the developer conveying direction. Accordingly, developer conveyed to the collecting auger 71 is pushed downward in the rear side region in which the collecting auger 71 rotates from the upper part in the gravitational direction to the lower part in the gravitational direction. Then, the developer is pushed upward in the front side area in which the collecting auger 71 rotates from the lower part in the gravitational direction to the upper part in the gravitational direction. As a result, the developer is conveyed to the downstream side in a state where the developer is distributed to be inclined to the front side, as shown in FIG. 8B, in the whole range of the collecting passage 62.

In FIGS. 6, 7, and 8A, a sectional area of the collecting passage 62 is defined as an area thereof between the wall surface of the collecting passage 62 and the collecting auger 71 in a section perpendicular to the upward direction of the rotation shaft 71*a* of the collecting auger 71, in the part of the collecting passage 62 upper than the rotation shaft 71*a* in the gravitational direction. In this case, a sectional area A1 on a side, in which the collecting auger 71 rotates from the upper part of the collecting passage 62 in the gravitational direction toward the lower part thereof in the gravitational direction, is set larger than a sectional area A2 on a side, in which the collecting auger 71 rotates from the lower part of the collecting passage 62 in the gravitational direction toward the upper part thereof in the gravitational direction. That is, in a sectional area of the collecting passage 62, a sectional area on a side, in which the collecting auger 71 rotates from the upper part of the collecting passage 62 in the gravitational direction toward the lower part thereof in the gravitational direction, is set larger than a sectional area on a side, in which the collecting auger 71 rotates from the lower part of the collecting passage 62 in the gravitational direction toward the upper part thereof in the gravitational direction. Consequently, the region of the sectional area A1 is secured as an air ventilation passage A1 extended in the developer conveying direction of the collecting passage 62.

In FIGS. 6, 7, and 8C, the image carrying body cleaner discharging connection passage 64 has an inclined inflow wall 64*a* extended from the front side of the collecting passage 62 toward the front in a diagonally upward direction. In the rear side of the image carrying body cleaner discharging connection passage 64, an eaves wall 64*b* having a eaves shape extended from the rear side toward the front side in the upper end of the collecting passage 62 and a vertical wall 64*c* extended upward from the front end of the eaves wall 64*b*. At the upper end of the image carrying body cleaner discharging connection passage 64, a collected developer receiving port 64*d* connected to the residue outlet 46*a* is formed. The collected developer receiving port 64*d* is disposed at an a centric position on the front side from the rotational center of the collecting auger 71, that is, the side of the region of the sectional area A2 opposite to the region of the wide sectional area A1, with respect to the lower collecting passage 62. Consequently, the image carrying body cleaner discharging connection passage 64, with respect to the collecting passage 62, is connected to the narrow sectional area A2 side, and is set so that the developer collected from the image carrying body cleaners CLy to CLk and entering through the residue outlet 46*a* is conveyed by mostly dropping down to the front side of the collecting passage 62.

In FIGS. 6, 7, 8D, and 8E, the developing device discharge connection passage 63 includes a vertical wall 63*a* extended upward from the center portion of the collecting passage 62 in a frontward and backward direction, and an inclined discharge wall 63*b* extended backward from the rear portion of the collecting passage 62 in the diagonally upward direction. In FIGS. 7C, 8D, and 8E, in the inclined discharge wall 63*b*, a groove portion 63*c* as an example of a sectional area extension portion is formed on the downstream side in the direction of developer conveyed by the collecting auger 71. Accordingly, due to the groove portion 63*c* as shown in FIGS. 8D and 8E, a sectional area of the developing device discharge connection passage 63 is defined as an area thereof in a section perpendicular to the direction of the rotation shaft 71*a* of the collecting auger 71. In this case, a sectional area thereof on the downstream side of the collecting auger 71 in the developer conveying direction is formed larger than a sectional area thereof on the upstream side thereof. Specifically, due to the groove portion 63*c*, in the developing device discharge connection passage 63, the bottom surface thereof is downwardly inclined from the upstream side of the collecting auger 71 toward the downstream side thereof in the developer conveying direction.

In the upper end of the developing device discharge connection passage 63, a collected developer receiving port 63*d* connected to the developer outlet 3*b* of each of the developing devices Gy to Gk. Accordingly, with respect to the collecting passage 62, the developing device discharge connection passage 63 of Example 1 is connected to the larger sectional area A1 side of the collecting passage 62. Accordingly, developer entering through the collected developer receiving port 63*d* flows through the surface of the inclined discharge wall 63*b* into the collecting passage 62, and air in the developing devices Gy to Gk flows through the developing device discharge connection passage 63.

Effect of Example 1

In the image forming apparatus U of Example 1 having the configuration mentioned above, the developing rollers ROy to ROk rotates as accompanied with an operation of the developing devices Gy to Gk, and air flows into the developing container V by the rotation of the developing rollers ROy to ROk. In the image forming apparatus U of Example 1, air in the developing container V is exhausted to the air intake fan FN through the developer outlet 3*b* of the developing container V, the developing device discharge connection passage 63, the collecting passage 62, the developer collecting container 70, and the ventilating passage HR. Accordingly, pressure rise in the developing container V is reduced, and thus leakage of developer from the vicinity of the developing rollers ROy to ROk of the developing container V and contamination in the image forming apparatus U are reduced. In this case, in Example 1, in the collecting passage 62, the area of the region of the sectional area A1 side opposite to the side to which developer is inclined in the rotation direction of the collecting auger 71 is formed large, the collecting passage 62 is hard to be blocked by being filled with developer, it is suppressed that air flow passage of the sectional area A1 is blocked by developer, and thus the air flow resistance is reduced. Specifically, in the image forming apparatus U of Example 1, leakage of developer at the time when air is leaked from the developing rollers ROy to ROk side by increasing the internal pressure of the developing devices Gy to Gk is reduced, and thus contamination in the image forming apparatus U is reduced.

In addition, in the image forming apparatus U of Example 1, developer collected by the image carrying body cleaners CLy to CLk and entering through the residue outlet 46*a* is conveyed by mostly dropping in the front side of the collecting passage 62, is hard to flow into the air flow region of the rear side, and thus it is hard to obstruct the air flow therein. Particularly, due to the eaves wall 64*b*, developer is hard to flow into the air flow region of the rear side, and thus it is hard to obstruct the air flow therein.

In addition, in the image forming apparatus U of Example 1, the developing device discharge connection passage 63 is connected to the larger sectional area A1 side of the collecting passage 62 with respect to the collecting passage 62, and the air flowing from the developing devices Gy to Gk is surely and rapidly guided into the secured air flow passage. In addition, in the developing device discharge connection passage 63 of Example 1, due to the groove portion 63*c*, a sectional area of the developing device discharge connection passage 63 is defined as an area thereof in a section perpendicular to the direction of the rotation shaft 71*a* of the collecting auger 71. In this case, a sectional area thereof on the downstream side of the collecting auger 71 in the developer conveying direction is formed larger than a sectional area thereof on the upstream side thereof. In addition, the developer flowing in the upstream side in the developer conveying direction of the developing device discharge connection passage 63 is conveyed through the collecting passage 62 toward the downstream side thereof, and thus the sectional area on the downstream increases although volume of the developer increases. As a result, it is suppressed that the air flow region is blocked by developer.

Example 2

Next, Example 2 of the invention will be described. In the following description of Example 2, in the case where common elements corresponding to Example 1 exist, those elements will be referenced by the same reference numerals and detailed description thereof will be omitted.

Example 2 is different from Example 1 mentioned above in the following configurations, but the other configurations are the same as Example 1.

Figure 9:
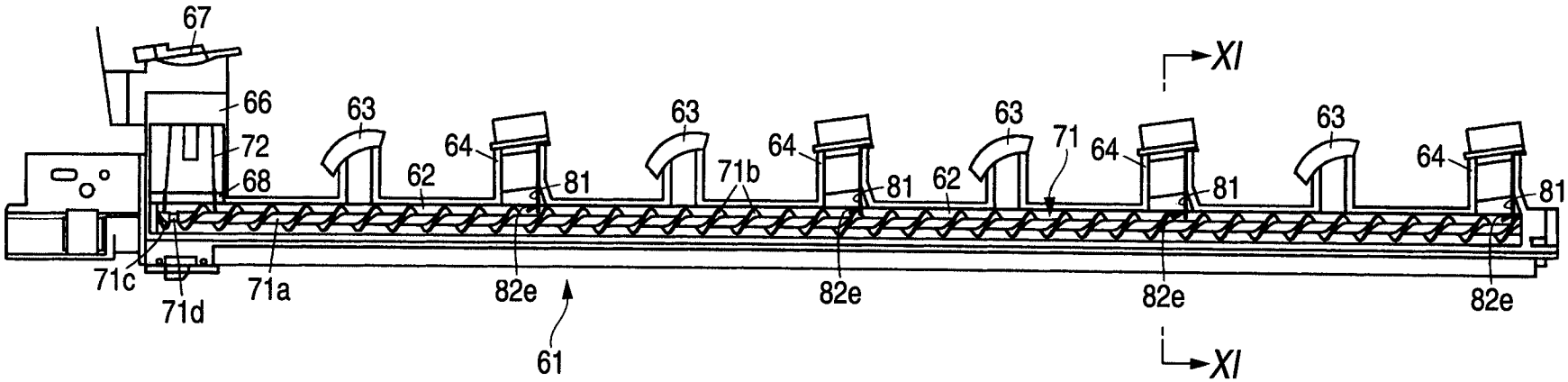
FIG. 9 is an explanatory sectional view illustrating a principal part of a collected developer conveying device according to Example 2.

FIG. 9 is an explanatory sectional view illustrating a principal part of a collected developer conveying device according to Example 2.

Figure 10:
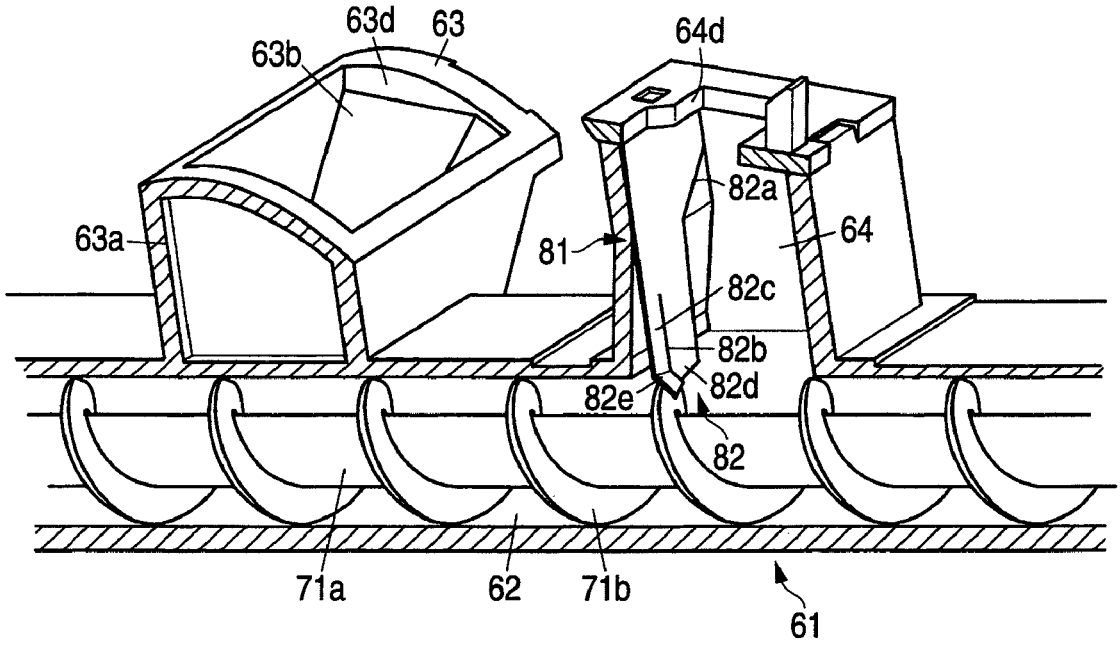
FIG. 10 is a perspective explanatory view illustrating an inflow passage according to Example 2.

FIG. 10 is a perspective explanatory view illustrating an inflow passage according to Example 2.

Figure 11:
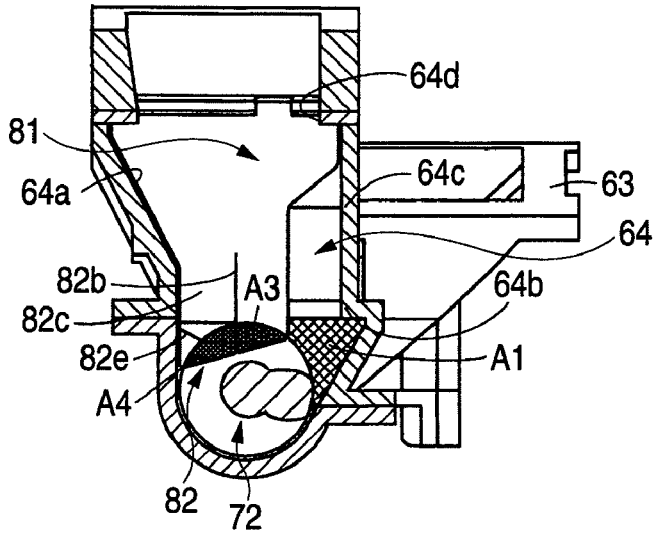
FIG. 11 is a sectional view taken along the line XI-XI shown in FIG. 9.

FIG. 11 is a sectional view taken along the line XI-XI shown in FIG. 9.

In FIGS. 9 to 11, in the developer collecting device 61 of Example 2, a loosening film 81 as an example of a loosening member is disposed on each of the image carrying body cleaner connection passages 64. In the loosening film 81, an upper end portion thereof is adhered to an upper end of a left end wall of the image carrying body cleaner connection passage 64. A lower end of the film 81 is extended downward, and the film 81 has a loosening portion 82 coming into contact with the helical blade 71*b* of the collecting auger 71. The loosening portion 82 is formed corresponding to the front side portion that corresponds to the region of the sectional area A2 of the collecting passage 62, and the rear portion 82*a* corresponding to the region of the wide sectional area A1 is cut off. Accordingly, one side thereof, in which the collecting auger 71 rotates from the lower part of the collecting passage 62 toward the upper part thereof in the gravitational direction, is formed larger in the horizontal direction than the other side thereof, in which the collecting auger 71 rotates from the upper part thereof toward the lower part thereof in the gravitational direction. In addition, due to the rear side cut-off portion 82*a* and the eaves wall 64*b*, most of the air flow passage A1 is formed outer in the horizontal direction than the loosening portion 82 of the loosening film 81.

In addition, in the loosening portion 82, an incision portion 82*b* extended upward from a lower end thereof is formed, a large amplitude loosening portion 82*c* is formed on a front side thereof that is divided by the incision portion 82*b* in the horizontal direction, and a small amplitude loosening portion 82*d* is formed on a rear side thereof. In addition, the lower end of the loosening portion 82 is inclined upward as it moves from the front side to the rear side. In addition, in FIGS. 9 and 10, at the fore part of the lower end of the loosening portion 82, a bent portion 82*e* is diagonally formed to be bendable toward the downstream side in the conveying direction of the collecting auger 71, as an example of a jamming prevention portion.

In FIG. 11, in the loosening film 81, an area A4 overlapped with the collecting passage 62 on one side thereof, in which the collecting auger 71 rotates from the lower part of the collecting passage 62 toward the upper part thereof in the gravitational direction, is formed larger than an area A3 overlapped with the collecting passage 62 on the other side thereof, in which the collecting auger 71 rotates from the upper part of the collecting passage 62 toward the lower part thereof in the gravitational direction. Specifically, the maximum length that the large amplitude loosening portion 82*c* comes into contact with the helical blade 71*b* is set larger than the maximum length that the small amplitude loosening portion 82*d* comes into contact with the helical blade 71*b*. In addition, when the large amplitude loosening portion 82*c* is reciprocated by being elastically deformed in contact with the helical blade 71*b* and being elastically returned apart from the helical blade 71*b*, amplitude of the reciprocation of the large amplitude loosening portion 82*c* is set larger than amplitude of the reciprocation of the small amplitude loosening portion 82*d*.

Accordingly, as accompanied with the rotation of the collecting auger 71, the helical blade 71*b* and the loosening portion 82 repeats contact and separation to/from each other, and so the loosening portion 82 is bounced. Thus, developer attached to the wall surface of the image carrying body cleaner connection passage 64 is loosened by the reciprocation. In this case, the lower end of the loosening portion 82 is inclined upward as it moves backward, and also the overlapped area is set larger on the front side. Thus, the amplitude of the reciprocation of the large amplitude loosening portion 82*c* becomes larger than the amplitude of the reciprocation of the small amplitude loosening portion 82*d*.

In addition, the bent portion 82*e* comes into contact with the helical blade 71*b* on the downstream side in the developer conveying direction in an inclined state, when the loosening portion 82 is elastically returned by being bounced. Accordingly, when the bent portion 82*e* is not formed, the lower outside part of the loosening portion 82 is too returned, and so is jammed inside or is folded back by coming into contact with the conveyor blade 71*b*, thereby obviating the problems of reduction in contact area and halt of reciprocation. In addition, in Example 1, a folded part of the bent portion 82*e* is set to be a start position of contact between the loosening member 81 and the conveyor blade 71*b*.

Effect of Example 2

In the image forming apparatus U of Example 2 having the configuration mentioned above, due to the loosening film 81, developer staying and blocking in the image carrying body cleaner connection passage 64 is reduced. In addition, the problem that a lump shaped developer formed by staying drops down into the collecting passage 62, blocks the collecting passage 62, and thus obstructs air flow is reduced.

In addition, in Example 2, in the rear side thereof in the range of the air flow passage, the loosening portion 82 is cut off, and air stirring action at the time of reciprocation of the small amplitude loosening portion 82*d* that reciprocates with small amplitude is reduced. Thus, the air flow resistance is further reduced.

In addition, the loosening portion 82 is divided into the large amplitude loosening portion 82*c* and the small amplitude loosening portion 82*d*. Thus, as compared with a case where one film reciprocates without division, noise and abrasion at the time of reciprocation is reduced.

Example 3

Next, Example 3 of the invention will be described. In the following description of Example 3, in the case where common elements corresponding to Examples 1 and 2 exist, those elements will be referenced by the same reference numerals and detailed description thereof will be omitted.

Example 3 is different from Examples 1 and 2 mentioned above in the following configurations, but the other configurations are the same as Examples 1 and 2.

Figure 12:
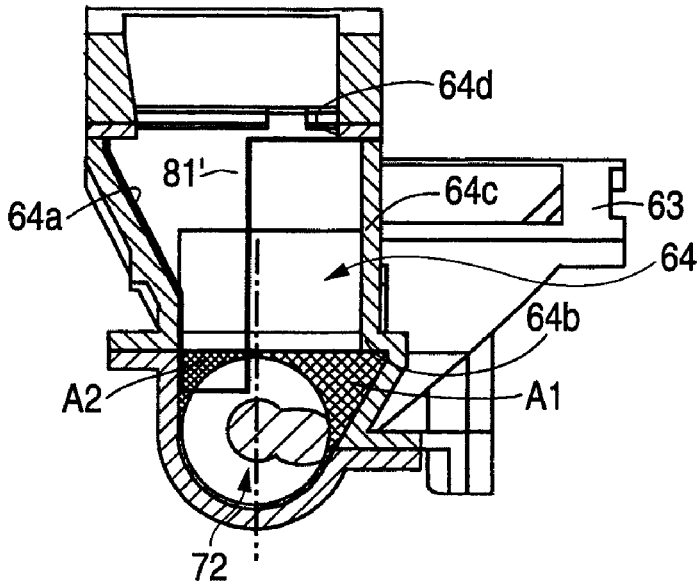
FIG. 12 is an explanatory view illustrating an inflow passage according to Example 3, and corresponding to FIG. 11 of Example 2.

FIG. 12 is an explanatory view illustrating an inflow passage according to Example 3, and corresponding to FIG. 11 of Example 2.

In FIG. 12, in the developer collecting device 61 of Example 3, instead of the loosening film 81 of Example 2, a loosening frame body 81' is disposed as an example of a loosening member. The loosening frame body 81' of Example 3 is formed by bending a wire shaped member, an upper end portion thereof is supported by the image carrying body cleaner connection passage 64, and a lower end thereof is formed to come into contact with the collecting auger 71.

In addition, in Example 3, the loosening frame body 81' is set to come into contact with the collecting auger 71 on one side thereof, in which the collecting auger 71 rotates from the lower part of the collecting passage 62 toward the upper part thereof in the gravitational direction. Also, the detaching frame body 81' is set to be separated from the collecting auger 71 on the other side thereof, in which the collecting auger 71 rotates from the upper part of the collecting passage 62 toward the lower part thereof in the gravitational direction. Consequently, the loosening frame body 81' is formed on the side thereof, in which the collecting auger 71 rotates from the lower part of the collecting passage 62 toward the upper part thereof in the gravitational direction.

Effect of Example 3

In the image forming apparatus U of Example 3 having the configuration mentioned above, accompanied with rotation of the collecting auger 71, the loosening frame body 81' reciprocates by being bounced, the developer in the image carrying body cleaner connection passage 64 is loosened, and thus developer staying and blocking is reduced. In addition, the problem that a solidified developer formed by staying drops down and blocks the collecting passage 62, and thus obstructs air flow is reduced.

In addition, the loosening frame body 81' of Example 3 is formed in a frame body shape of a bent wire, and air stirring action at the time of reciprocation is reduced as compared with the film shaped member similar to the loosening film 81 of Example 2. In addition, the loosening frame body 81' is set to be separated from the collecting auger 71 on the other side thereof, in which the collecting auger 71 rotates from the upper part of the collecting passage 62 toward the lower part thereof in the gravitational direction. Thus, air flow resistance is further reduced.

Example 4

Next, Example 4 of the invention will be described. In the following description of Example 4, in the case where common elements corresponding to Examples 1 to 3 exist, those elements will be referenced by the same reference numerals and detailed description thereof will be omitted.

Example 4 is different from Examples 1 to 3 mentioned above in the following configurations, but the other configurations are the same as Examples 1 to 3.

Figure 13:
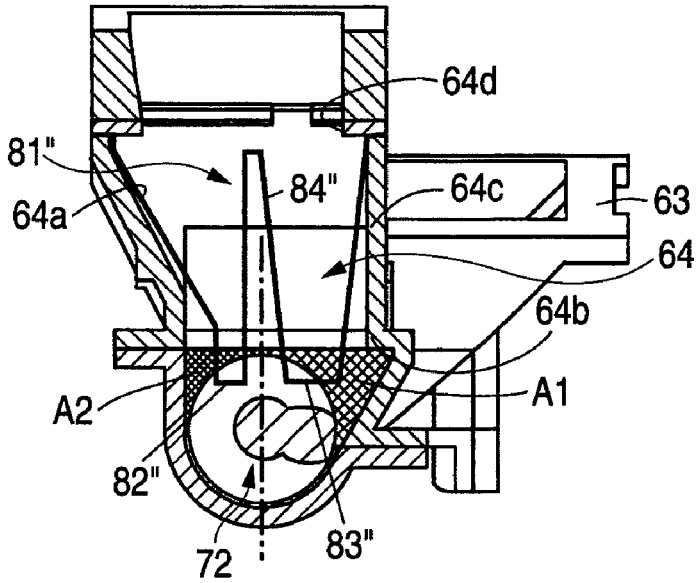
FIG. 13 is an explanatory view illustrating an inflow passage according to Example 4, and corresponding to FIG. 12 of Example 3.

FIG. 13 is an explanatory view illustrating an inflow passage according to Example 4, and corresponding to FIG. 12 of Example 3.

In FIG. 13, in the developer collecting device 61 of Example 4, instead of the loosening film 81' of Example 3, a loosening frame body 81" is disposed as an example of a loosening member. The loosening frame body 81" includes a front side loosening portion 82" formed corresponding to the region of the narrow sectional area A2, a rear side loosening portion 83" formed corresponding to the region of the wide sectional area A1, and a connection loosening portion 84" bent upward and interconnecting the front side loosening portion 82" and the rear side loosening portion 83". The loosening frame body 81" of Example 4 is formed by bending a wire shaped member, an upper end portion thereof is supported by the image carrying body cleaner connection passage 64, and the loosening portions 82" and 83" are formed to come into contact with the collecting auger 71.

In addition, in Example 3, a width of the front side loosening portion 82" in the horizontal direction is smaller than a width of the rear side loosening portion 83" in the horizontal direction.

Effect of Example 4

In the image forming apparatus U of Example 4 having the configuration mentioned above, accompanied with rotation of the collecting auger 71, the front side loosening portion 82" and the rear side loosening portion 83" of the loosening frame body 81" reciprocates by being bounced, the developer in the image carrying body cleaner connection passage 64 is loosened. When the front side loosening portion 82" and the rear side loosening portion 83" are bounced and vibrates, the vibration is transferred to a connection loosening portion 84" connected thereto, and the connection loosening portion 84" vibrates too, thereby loosening developer. With such a configuration, developer staying and blocking in the image carrying body cleaner connection passage 64 is reduced, and air flow resistance is reduced.

In addition, in the loosening frame body 81" of Example 4 similarly to the loosening frame body 81' of Example 3, air stirring action at the time of reciprocation is reduced, and air flow resistance is reduced. In addition, in Example 4, due to eaves wall 64*b*, the air flow passage A1 is disposed outer than the loosening frame body 81", and thus air flow resistance is reduced.

Modified Example

As described above, the examples of the invention has been described in detail. However, the invention is not limited to the examples mentioned above, and may be modified in various forms without departing from the technical spirit of the invention described in Claims. Modified examples (H01) to (H09) of the invention will be described as follows.

(H01) In the examples mentioned above, the copier is employed as an example of the image forming apparatus, but the invention is not limited to this, and it is possible to employ a FAX, a printer, or a multi-function printer having all function of those or a plurality of functions. In addition, there are exemplarily shown the four color image carrying bodies PRy to PRk and the image forming apparatus having the developing devices Gy to Gk and the latent image forming devices LHy to LHk. However, the invention is not limited to this, and it is possible to apply to a single image forming apparatus and a rotation-type image forming apparatus in which one image carrying body and one latent image forming device are formed and four developing devices are sequentially face to the one image carrying body by being rotated. In addition, the invention is not limited to the latent image forming device constituted of so called LED arrays, and it is possible to employ the known latent image forming device such as a latent image forming device using a rotating multi-faceted mirror.

(H02) In the Example, the magnetic member 24 is preferably provided, but can be omitted.

(H03) In the Example, the loosening members 81, 81', and 81" are disposed in the image carrying body cleaner connection passage 64, but can be omitted and can be disposed in the developing device discharge connection passage 63.

(H04) In the Example, the image carrying body cleaner connection passage 64 and the like can be omitted when the collected developer is reused by the image carrying body cleaners CLy to CLk and so is not collected.

(H05) In the Example, gas is exhausted from the developer collecting container 70, but the invention is not limited to this, and it is possible to configure that the gas is exhausted from the collecting passage 62 having the secured air flow passage.

(H06) In the Example, there is exemplarily shown the circulation stirring space 6+7 in which the first stirring space 6 and the second stirring space 7 are disposed to be deviated from each other in the gravitational direction and the horizontal direction. However, the invention is not limited to this, and can be applied to a case of a vertical type circulation stirring space in which the first stirring space and the second stirring space are arranged in the gravitational direction and a horizontal type circulation stirring space in which the first stirring space and the second stirring space are arranged in the horizontal direction. Accordingly, the invention is not limited to the configuration in which the developer outlet 3*b* discharges developer from the lower surface of the first stirring space 6, and can employ the known configuration in which a part of the developer overflows through the outlet. In addition, the invention can be applied to a configuration in which one component developer is used or carrier is not discharged, that is, a configuration in which a developing device does not have any outlet. In this configuration, only a ventilation port for drawing air is formed, and the ventilation port can be formed on an optional position such as a cover top which has low possibility of being blocked by developer. In this case, the developing device discharge connection passage 63 has a function as a ventilation passage only for discharging air. In addition, in the configurations of Examples 1 to 3, it is preferable to employ a configuration in which the ventilation passage and the developing device discharge connection passage 63 is commonly used. However, independently of the developer discharge passage, it is possible to provide a ventilation passage only for discharging air.

(H07) In the Example 2, there is exemplarily shown the configuration in which the loosening portion 82 is divided into two by the incision portion 82*b*. However, the invention is not limited to this, the loosening portion 82 can be divided into three or more, and one loosening portion can be employed without division. In addition, a width of the large amplitude loosening portion 82*c* in the frontward and backward direction, the horizontal direction, is formed larger than a width of the small amplitude loosening portion 82*d* in the horizontal direction. The setting is preferred in view point of air dispersion prevention, noise, and the like, but the invention is not limited to this, and can be modified to various forms.

(H08) In the Example 2, the vent portion 82*e* is preferably provided, but can be omitted.

(H09) In the Example 4, the widths of the front side loosening portion 82" and the rear side loosening portion 83" are not limited to the exemplary configuration, and can be optionally modified to various forms.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A collected developer conveying device comprising:

a conveying passage through which collected developer is conveyed;

a conveying member that is disposed in the conveying passage, and conveys the developer in the conveying passage by rotation thereof;

a developer carrying body that holds developer on a surface thereof, and that is rotatable; and a ventilation passage through which air passes from a developing container that includes the developer carrying body, wherein:

the conveying member defines a conveying cylinder in which the conveying member rotates, the conveying passage includes an air flow region which is a region defined between the conveying cylinder and a portion of an outer boundary of the conveying passage which is provided above a rotational center of the conveying member in a gravitational direction and provided in a side of the conveying passage in which the conveying member rotates from an upper part of the conveying passage to a lower part thereof in the gravitational direction, the conveying passage includes a second region which is a region defined between the conveying cylinder and a portion of an outer boundary of the conveying passage which is provided below a rotational center of the conveying member in a gravitational direction and provided in a side of the conveying passage in which the conveying member rotates from an upper part of the conveying passage to a lower part thereof in the gravitational direction, and a sectional area of the air flow region, which is taken along a plane which is perpendicular to an axis around which the conveying member rotates, is larger than a sectional area, which is taken along the perpendicular plane, of the second region.

2. A collected developer conveying device comprising:

a conveying passage through which collected developer is conveyed;

a conveying member that is disposed in the conveying passage, and conveys the developer in the conveying passage by rotation thereof;

a developer carrying body that holds developer on a surface thereof, and that is rotatable; and a ventilation passage through which air passes from a developing container that includes the developer carrying body, wherein:

the conveying passage is connected to the ventilation passage, a sectional region of the conveying passage located above a rotational center of the conveying member in a gravitational direction is divided by a perpendicular line that intersects a rotation-axis of the conveying member, and a sectional area of a first side of the sectional region of the conveying passage, in which the conveying member rotates from an upper part of the conveying passage toward a lower part thereof in the gravitational direction, is larger than a sectional area of a second side of the sectional region of the conveying passage, in which the conveying member rotates from the lower part thereof toward the upper part thereof in the gravitational direction.

3. The collected developer conveying device as claimed in claim 1, further comprising:

a loosening member that is disposed in an inflow passage of the collected developer in the conveying passage, and loosens the developer in the inflow passage, wherein:

the air flow region is formed farther away from the rotational center of the conveying member than the loosening member in a horizontal direction.

4. The collected developer conveying device as claimed in claim 3, wherein:

the ventilation passage is formed farther away from the rotational center of the conveying member than the loosening member in the horizontal direction.

5. The collected developer conveying device as claimed in claim 1, further comprising:

a loosening member that is disposed in an inflow passage of the collected developer in the conveying passage, and loosens the developer in the inflow passage, wherein a first side of the loosening member, in which the conveying member rotates from the lower part of the conveying passage toward the upper part thereof in the gravitational direction, is formed larger in a horizontal direction than a second side thereof, in which the conveying member rotates from the upper part thereof toward the lower part thereof in the gravitational direction.

6. The collected developer conveying device as claimed in claim 1, further comprising:

a loosening member that is disposed in an inflow passage of the collected developer in the conveying passage, and loosens the developer in the inflow passage, wherein a first side of the loosening member, in which the conveying member rotates from the upper part of the conveying passage toward the lower part thereof in the gravitational direction, is formed larger in a horizontal direction than a second side thereof, in which the conveying member rotates from the lower part thereof toward the upper part thereof in the gravitational direction.

7. The collected developer conveying device as claimed in claim wherein the loosening member is formed only in a side of the conveying passage in which the conveying member rotates from the lower part of the conveying passage toward the upper part thereof in the gravitational direction.

8. The collected developer conveying device as claimed in claim 1, further comprising:

a loosening member that is divided in a horizontal direction into loosening member portions, is disposed in an inflow passage of the collected developer in the conveying passage, and loosens the developer in the inflow passage, wherein:

the loosening member portions are arranged to be separated from each other in the horizontal direction, and an area of the loosening member that is overlapped with the conveying passage in a first side thereof, in which the conveying member rotates from the lower part of the conveying passage toward the upper part thereof in the gravitational direction, is larger than an area of the loosening member that is overlapped with the conveying passage in a second side thereof, in which the conveying member rotates from the upper part thereof toward the lower part thereof in the gravitational direction.

9. The collected developer conveying device as claimed in claim 2, further comprising:

a discharge passage in which the ventilation passage is formed, the ventilation passage passing developer discharged from the developing container and passing air from the developing container to the conveying passage, wherein, in a sectional region of the discharge passage in a section perpendicular to the rotation-axis direction of the conveying member, a sectional area thereof on a downstream side in a developer conveying direction of the conveying member is larger than a sectional area thereof on an upstream side in the developer conveying direction thereof.

10. The collected developer conveying device as claimed in claim 9, wherein the discharge passage is inclined so that the bottom surface thereof becomes gradually lower from the upstream side to the downstream side in a conveying direction of the conveying member.

11. The collected developer conveying device as claimed in claim 9, further comprising:

an inflow passage through which the collected developer flows from a cleaner for removing developer remaining on a surface of an image carrying body, wherein:

the inflow passage is connected to the second side of the sectional region of the conveying passage, and the developer discharge passage is connected to the first side of the sectional region of the conveying passage.

12. The collected developer conveying device as claimed in claim 1, further comprising:

an air intake unit that is connected to an air inlet of the developer collecting container, and draws air in the developer collecting container.

13. An image forming apparatus comprising:

an image carrying member in which a latent image is formed on a surface thereof;

a developing device that develops the latent image of the image carrying member into a visible image;

a transfer device that transfers the visible image of the image carrying body surface to a medium;

a cleaner that removes developer remaining on the image carrying body surface after the visible image is transferred to the medium;

a collected developer conveying device according to claim 1 that collects the developer collected by the cleaner; and a fixing device that fixes the visible image of the medium surface.

14. The image forming apparatus as claimed in claim 13, wherein:

the collected developer conveying device comprises:

a loosening member that is disposed in an inflow passage of the collected developer in the conveying passage, and loosens the developer in the inflow passage, and the air flow region is formed farther away from the rotational center of the conveying member than the loosening member in a horizontal direction.

15. The image forming apparatus as claimed in claim 13, wherein:

the ventilation passage is formed farther away from the rotational center of the conveying member than the loosening member in the horizontal direction.

16. The image forming apparatus as claimed in claim 13, wherein the collected developer conveying device comprises:

a loosening member that is disposed in an inflow passage of the collected developer in the conveying passage, reciprocates to intermittently come in contact with the conveying member being rotating, and loosens the developer in the inflow passage, and a first side of the loosening member, in which the conveying member rotates from the lower part of the conveying passage toward the upper part thereof in the gravitational direction, is formed larger in a horizontal direction than a second side thereof, in which the conveying member rotates from the upper part thereof toward the lower part thereof in the gravitational direction.

* * * * *